US010648140B2

(12) United States Patent
Rieger et al.

(10) Patent No.: US 10,648,140 B2
(45) Date of Patent: May 12, 2020

(54) BRIDGE LAYING DEVICE FOR LAYING A BRIDGE, IN PARTICULAR A SINGLE-PIECE BRIDGE

(71) Applicant: Krauss-Maffei Wegmann GmbH & Co. KG, Munich (DE)

(72) Inventors: Alexander Rieger, Munich (DE); Uwe Beitz, Munich (DE); Markus Raff, Munich (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 16/478,529

(22) PCT Filed: Jan. 16, 2018

(86) PCT No.: PCT/DE2018/100030
§ 371 (c)(1),
(2) Date: Jul. 17, 2019

(87) PCT Pub. No.: WO2018/133901
PCT Pub. Date: Jul. 26, 2018

(65) Prior Publication Data

US 2019/0345679 A1 Nov. 14, 2019

(30) Foreign Application Priority Data

Jan. 17, 2017 (DE) ..... 10 2017 100 815

(51) Int. Cl.
*E01D 15/00* (2006.01)
*E01D 15/127* (2006.01)
*E01D 21/10* (2006.01)

(52) U.S. Cl.
CPC ..... *E01D 15/127* (2013.01); *E01D 21/10* (2013.01)

(58) Field of Classification Search
CPC ..... E01D 15/247; E01D 21/10
(Continued)

(56) References Cited

U.S. PATENT DOCUMENTS 3,491,391 A * 1/1970 Söffge ..... E01D 15/127 14/2.4
3,820,181 A * 6/1974 Wagner et al. ..... E01D 15/127 14/2.5

(Continued)

FOREIGN PATENT DOCUMENTS

| | | |
|---|---|---|
| DE | 10127136 B4 | 7/2010 |
| EP | 0453422 A1 | 10/1991 |
| WO | 90/05216 A1 | 5/1990 |

OTHER PUBLICATIONS

PCT, European Patent Office (ISA/EP), International Search Report, International Application No. PCT/DE2018/100030, 5 pages, dated Apr. 9, 2018.

(Continued)

*Primary Examiner* — Raymond W Addie
(74) *Attorney, Agent, or Firm* — Thompson Hine LLP

(57) ABSTRACT

A bridge laying device (2) for laying a bridge (3), in particular a single-piece bridge, includes a main part (5) for arranging on a load transport vehicle (7), in particular a hook-lift vehicle, a laying arm (12) for setting down the bridge (3), and an extending device (6) for moving the laying arm (12) from a transport position into an extended placing position. In certain embodiments, a bridge laying system (1) includes a load transport vehicle (7), in particular a hook-lift vehicle, and a bridge laying device, (2) which can be arranged on the load transport vehicle (7). A method for laying a bridge (3), in particular a single-piece bridge, using a bridge laying device (2) includes moving an extending (Continued)

device (6) for moving the laying arm (12) from a transport position into an extended placing position.

14 Claims, 3 Drawing Sheets

(58) Field of Classification Search
USPC ..... 14/2.4, 2.5, 77.4, 78, 77.1
See application file for complete search history.

(56) References Cited

U.S. PATENT DOCUMENTS 4,288,881 A * 9/1981 Mahncke ..... E01D 15/127 14/2.5
4,493,122 A * 1/1985 Echtler ..... E01D 15/127 14/2.4
5,063,630 A * 11/1991 Wiedeck ..... E01D 15/127 14/2.4
5,179,751 A * 1/1993 Wiedeck ..... E01D 15/127 14/2.4
5,363,527 A * 11/1994 Rainaud ..... E01D 15/127 14/2.4
5,385,219 A * 1/1995 Snell ..... E01D 15/127 14/2.5
5,443,584 A * 8/1995 Diefendahl ..... E01D 15/127 14/2.4
6,611,982 B2 * 9/2003 Eberl ..... E01D 15/127 14/2.4
7,174,591 B2 * 2/2007 Bertrand ..... E01D 15/127 14/2.4
7,543,347 B2 * 6/2009 Green ..... E01D 15/127 14/2.4
8,096,010 B2 * 1/2012 Richeux ..... B60F 3/0061 14/2.4
2012/0074035 A1 3/2012 Deschamps

OTHER PUBLICATIONS

PCT, The International Bureau of WIPO, Translation of the International Preliminary Report on Patentablity, International Application No. PCT/DE2018/100030, 7 pages, dated Aug. 1, 2019.

* cited by examiner

BRIDGE LAYING DEVICE FOR LAYING A BRIDGE, IN PARTICULAR A SINGLE-PIECE BRIDGE

TECHNICAL FIELD

The present invention relates to a bridge laying device for laying a bridge, in particular a single-piece bridge with a main part for arranging on a load transport vehicle, in particular a hook lift vehicle, and a laying arm for setting down the bridge. The invention further relates to a bridge laying system with a load transport vehicle, in particular hook lift vehicle, and with a bridge laying device, which can be arranged on the load transport vehicle, and also to a method for laying a bridge, in particular a single-piece bridge, with a bridge laying device.

BACKGROUND

Bridge laying devices are used, for example in the military sector, for transporting and laying a transportable bridge. Suchlike bridges are deployed if a bridge is to be used only for a specified period for crossing an obstacle, for example a river. The bridge can then be transported to its installation site by means of a bridge laying vehicle and can be laid over the obstacle there with a bridge laying device. As soon as the bridge is no longer required, it can then be picked up once more with the bridge laying device and can be transported to another installation site.

Known bridge laying devices can be arranged, for example, on combat vehicles such as tanks or the like. However, bridge laying devices which are configured for arranging on a load transport vehicle, for example a hook lift vehicle, are also known. In this respect, it is not necessary to make available a special bridge laying vehicle, by means of which the bridge laying devices can be transported and the bridges can be laid.

For example, a military rapid-deployment bridge system that is capable of being laid in cantilever form and is transportable by means of air, rail, water or land vehicles is known from DE 101 27 136 BE. A bridge laying device with a main part for arranging on a load transport vehicle is proposed there. The main part has a laying arm for setting down the bridge, which is configured for the transfer of in particular a two-piece bridge initially in a connected state. In a suchlike embodiment, the bridge and in particular also the bridge laying device can be dimensioned so that it conforms to a stipulated loading dimension, such as a standard ISO size. The two-piece bridge can be assembled and can then be laid by the vehicle with the help of the bridge laying device.

In bridge laying devices of this type and, in particular, also suchlike bridge laying systems of this type, it has been found to be disadvantageous that it is frequently not possible to approach sufficiently closely to an obstacle with these devices, in order thereby to be able to carry out a satisfactory laying process. There is also a further disadvantage, because of the two-piece design of the bridge, that no high loads can be picked up in the connected state. Because of this, the passage of a suchlike bridge is only possible with restricted vehicles.

SUMMARY

Against this background, the invention thus has as its object to propose a bridge laying device, by means of which larger distances between a vehicle and an obstacle are also capable of being bridged while maintaining high stability.

For the accomplishment of this object, an extending device for moving the laying arm from a transport position into an extended placing position is proposed in a bridge laying device of the kind mentioned by way of introduction.

The overall length of the bridge laying device can be increased by a suchlike extending device for moving the laying arm from a transport position into an extended placing position. Larger distances between the vehicle and the obstacle to be bridged can also be overcome in this way. The stability can preferably be increased further, since the bridge is laid in the immediate vicinity of the vehicle, rather than at a greater distance from it. As a result, a more favorable center of gravity can be obtained when laying the bridge. The bridge laying device can be brought directly adjacent to the obstacle in this way, and the laying process can be simplified thereby. In addition, the advantage that higher loads when crossing the bridge can be absorbed by the bridge itself can also be achieved by the use of a single-piece bridge. Unlike a two-piece bridge, which must first be connected, a distinctly more stable bridge can be realized because of the single-piece design. Heavy vehicles, for example tanks, are thus also able to cross the bridge. It is not necessary in this case, for example, for standard loading dimensions to be satisfied.

An advantageous embodiment proposes that the extending device is arranged on the main part and is capable of displacement in relation to the main part, in particular in the horizontal direction. A coherent, compact design of the bridge laying device can be achieved as a result. Since the extending device is arranged on the main part, rather than on the vehicle, a design that is independent of the load transport vehicle can be accomplished. The bridge laying device can thus be made available as an autonomous unit, without it being necessary for the bridge laying device to be arranged permanently on a load transport vehicle. The extending device can preferably be arranged above the main part, so that displaceability in the horizontal direction can be assured in a simple manner in the absence of sources of interference.

It is preferable if the extending device is capable of extension in the laying direction of the bridge. As a result, it is possible in a simple manner to offer a possibility, by means of which the distance behind the vehicle is capable of being bridged. The bridge laying device can be extended in the direction of the obstacle by moving the extending device in the laying device. In this context, the expression "extension" is not restricted purely to a driving motion. In point of fact, other movement possibilities can also be subsumed under this expression including, for example, swinging outwards, sliding outwards or the like. The extending device can preferably exhibit rail elements, via which the extending device can be moved in relation to the main part. The bridge laying device and in particular the laying arm of the bridge laying device can be brought closer to the obstacle in this way, by so doing simplifying the laying process.

According to one constructive design embodiment, it is proposed that the length of the main part and the length of the bridge are substantially in a ratio of 1:5, preferably in a ratio of 1:3 and most preferably in a ratio of 1:2. An arrangement in which the loads on the bridge laying device can be evenly distributed can be produced in this way. It has emerged as being advantageous for the bridge to have a length in the region of 10 m to 20 m, preferably in the region of 12 m to 17 m, although most preferably substantially of 14 m, and for the main part, and in particular the entire bridge laying device in its non-extended state, to have a length in the region of 2.5 m to 13 m, preferably in the region of 5 m to 10 m, although most preferably substantially of 7 m. It is most preferable in this case if the length of the main part corresponds to the length of the load area of the load transport vehicle.

A preferred embodiment proposes that the bridge to be laid is configured in a single-piece. It has emerged as being particularly advantageous in this case if the bridge to be laid is configured so that it is ready for use in particular in the transport position. In this respect, it is no longer necessary for the bridge to be assembled or unfolded before the laying process. It is particularly advantageous if the bridge is a rigid bridge and not, for example, a foldable or a collapsible bridge.

In a further development of the invention, it is proposed that the laying arm is arranged on the extending device and is movable together with the extending device. The laying arm can carry the bridge in the transport position and in the placing position. Most preferably, the movements of the extending device, in particular its extension in the horizontal direction, and of the laying arm, in particular its pivoting, can take place independently of one another. In particular, the movements of the extending device and of the laying arm can be decoupled from one another. The extending device and/or the laying arm can thus be actuated electively. What is more, there is nothing here to prevent both actuation processes from taking place at the same time. Furthermore, the bridge can be lowered with the help of the laying arm during the laying process, and the bridge lying on the ground can be picked up once more during the picking-up process. The fact that the laying arm is arranged on the extending device enables the laying arm to be moved as required to any desired position, in particular behind the vehicle. The distance to be bridged in this case can be adjusted with the help of the extending device. It is thus possible to ensure that an unimpaired movement of the laying arm is possible, without this being prevented by other sources of interference. The laying arm is thus capable of being approached closely to the obstacle.

In this respect, it is most preferable if the laying arm is arranged about a pivot axis with a pivoting motion on the extending device, in particular on the front end of the extending device in the laying direction. A suchlike movement of the laying arm enables the pivot axis to be displaced to a pivot point close to the contour of the bridge laying device, so that the compressive forces acting on the laying arm and thus also on the pivot point during laying of the bridge can be led directly into the ground. In this way it is not necessary for the load transport vehicle to lie fully in the flow of forces and to transfer all of the compressive forces into the ground, so that the loading on the load transport vehicles can be reduced.

According to one constructive design embodiment, it is proposed that the laying arm is of substantially triangular geometry. The side of the laying arm for picking up the bridge can be formed for this purpose by an upper carrier, which can preferably be of solid configuration. This carrier can be aligned approximately parallel to the extending device, in particular in the transport position. A type of supporting structure consisting of further carriers can be provided on the underside of the upper carrier in order to produce the triangular geometry. The carriers forming the supporting structure can be of less solid configuration in comparison with the upper carrier. The supporting structure, and in particular the carriers of the supporting structure, can converge on one another in this case in the direction of the pivot point, resulting in the approximately triangular geometry of the laying arm. It is preferable if the pivot point, and thus also the pivot axis, is arranged in the region of a lower corner of the triangle, resulting in a comparatively low-level arrangement of the pivot point.

It is proposed in an advantageous manner that a drive element and roller guides for laying and/or picking up the bridge are provided on a carrier of the laying arm situated above in the transport position. The laying process can be undertaken substantially via the upper carrier. The bridge can be driven by the drive element of the laying arm during the laying process and can be brought into a laid position. The bridge can be guided via the roller guides in the process.

A preferred embodiment provides for the laying arm to be capable of pivoting via a laying drive arranged on the extending device, in particular via a length-adjustable hydraulic cylinder. Various pivoting positions of the laying arm, of the kind that are required for laying and/or picking up the bridge, can be achieved as a result. It is preferable for the laying arm to be capable of being moved by means of the laying drives on a circulation path about the pivot axis. Most preferably the laying drive in this case can be configured as a hydraulic drive. In particular, an embodiment as a hydraulic cylinder, wherein the hydraulic cylinder can be arranged in a position above the vehicle and in particular on the extending device, has been found to be advantageous. It is advantageous in this case if the drive lying in the transport position is in substantially flush alignment with the horizontally oriented upper carrier of the laying arm.

A constructive design embodiment proposes that the laying drive in the transport position engages on an elevated point of the laying arm in relation to the pivot axis. The elevated arrangement of the point of contact permits a low-level arrangement of the pivot point. It has been found to be particularly advantageous in this respect if the pivot axis is arranged approximately centrally between the point of contact of the laying drive and the supporting surface of the load transport vehicle. A suchlike arrangement in addition enables a pivoting movement of the laying arm to be achieved via a pivoting area, which is necessary for laying the bridge on the supporting surface.

According to an illustrative embodiment of the invention, it is proposed that an extension drive for moving the extending device is arranged on the main part. An on the whole autonomous design of the bridge laying device can result from the arrangement of the extension drive on the main part. The extension drive is thus able to drive and move the extending device independently of the load transport vehicle. The extension drive can preferably be configured as a hydraulic drive.

More advantageously, a control device for the control of the laying arm and/or the extending device is arranged in particular on the main part. The movements of the laying arm and thus the laying process of the bridge, as well as the movement of the extending device, can be controlled via the control device. These procedures can also be undertaken independently of the load transport vehicle by a control device arranged on the main part. It is preferable for the control device and/or the extension drive to be arranged in a housing. The components can be protected from environmental influences in this way. More preferably, the control device and/or the extension drive can be arranged on a side of the main part situated opposite the laying arm.

The laying drive and/or the extension drive and/or the control device can preferably be supplied with energy via an autonomous energy source and/or via an electrical interface arranged on the main part. In addition, independence in relation to the load transport vehicle can be achieved in this way, so that autonomous operation of the bridge laying device is possible. A battery or the like, which can be arranged on the main part, can preferably be used as an energy source. As an alternative or in addition, an electrical interface can also be provided, for example a plug-in connection for the connection of two plug elements. As a result, the individual drives and/or the control device can be supplied with the required energy in this way.

Support devices for supporting the main part and/or the extending device in relation to the supporting surface are provided in an advantageous embodiment of the invention. The bridge laying device can preferably be set down on the supporting surface with the help of the support devices, whereby sufficient ground clearance can be assured. As an alternative or in addition, a bridge laying device arranged on the vehicle can be supported via the support devices at least partially in relation to the supporting surface, in order in so doing to improve the stability and the load transfer points into the ground. Preferably plate-like feet can be arranged on the support devices on the side facing the ground, so that a flat and level supporting surface can result. The feet can preferably be articulated with a pivoting motion on the support devices, so that a pivoting movement, for example when picking up or setting down the bridge laying device, can be achieved.

In this respect, a constructive design embodiment proposes at least four support devices for setting down the bridge laying device on the supporting surface, wherein in particular at least two support devices are arranged on the main part and at least two support devices are arranged on the extending device. The bridge laying device can be set down on the supporting surface, independently of a load transport vehicle, by means of the four support devices. Secure standing can be assured by the provision of four support devices. The arrangement of the support devices on the main part and/or the extending device also enables secure standing to be assured in an extended state of the bridge laying device.

It is also advantageous for the support devices arranged on the extending device to be of vertically adjustable configuration, and for the support devices arranged on the main part to be of rigid configuration. In the case of an arrangement on the load transport vehicle, these can also be lowered by means of vertically adjustable support devices in the direction of the supporting surface and can be brought into abutment with it. The support devices can be adapted in respect of their length to the distance to the ground, in order in so doing to increase the stability. The support devices arranged on the main part can be of rigid configuration, since these are intended substantially to be used only for setting down the bridge laying device on the supporting surface. In this respect, it is not necessary to embody these support devices in a height-adjustable manner. Embodiments are also conceivable, however, in which the support devices arranged on the main part are likewise embodied in a height-adjustable manner, whereby the flexibility can be further increased.

It is preferable for the support point of the support device to be capable of displacement by the extension of the extending device. The bridge laying device can be changed in respect of its length by the extension of the extending device. The fact that the support devices are arranged on the extending device means that the support devices are also displaced in this way. The support point can be further displaced as a result, whereby larger distances can be bridged while maintaining good stability.

A preferred embodiment proposes that, means for the attachment of the main part on a load transport vehicle, in particular an engagement device for receiving a hook arranged on a load transport vehicle, are provided on the main part. An interface between the bridge laying device and the load transport vehicle can be generated in this way. The means for the attachment of the main part in this case can preferably be configured as eyes, in which, for example, a hook of the load transport vehicles can engage. The engagement device can be configured, for example, as a standard container interface.

In this respect, it is particularly advantageous if the means of attachment of the main part are arranged on the side opposite the laying arm, in particular in an elevated position. As a result, loading of the bridge laying device can take place in a simple manner, for example without the laying arm or the like being in the way. Picking-up the main part by a hook arranged on the load transport vehicle can be simplified by the elevated position of the engagement device.

A carrier arm for carrying and retaining the bridge in the transport position is more preferable. The carrier arm can most preferably be arranged on the side opposite the laying arm. It has been found to be particularly advantageous in this case for the means of attachment of the main part to be arranged on the carrier arm. The carrier arm can further have means for fixing the bridge, for example bolts or the like, by means of which the bridge can be retained in the transport position on the carrier arm and can be fixed there. Slipping of the bridge in the transport position can thus be avoided. The fixing devices in the transport position can preferably be in a fixed position and can be opened for laying of the bridge.

It is more preferable if the main part has a sliding surface on its underside, via which the bridge laying device is loadable onto the load transport vehicle. The sliding surface can be a plane surface of the main part, for example, which is able to slide on the load area of the load transport vehicle via rollers arranged on the load transport vehicle. The most frictionless possible picking up of the bridge laying device can be facilitated in this way. As an alternative or in addition, roller elements can also be arranged in the region of the sliding surface.

The object of a bridge laying device capable of being arranged on the load transport vehicle according to one of the preceding embodiments for laying a bridge, in particular a single-piece bridge with a main part and a laying arm for setting down the bridge, is accomplished in a bridge laying system of the kind mentioned by way of introduction. The advantages achieved are the same as those which have already been described in conjunction with the bridge laying device. All of the characterizing features can find an application at the same time, either alone or in combination.

A bridge laying device can be transported to any desired installation site in a simple manner with an inventive bridge laying system. A load transport vehicle, which must not necessarily be configured as a bridge laying vehicle or the like, can be selected in this case. Hook lift vehicles of a kind which are used for the transport of standard containers, for example, can be used instead. In this way, the transport and thus the availability of transportable bridges can be improved in a simple manner.

An advantageous embodiment proposes that the bridge laying device is loadable together with the bridge in this case. A suchlike embodiment of the bridge laying device means that it is not necessary to load the bridge laying device on the vehicle first and then to pick up the bridge by means of the bridge laying device. Instead, the bridge laying device can be lifted onto the load transport vehicle together with the bridge. The overall loading times and operating sequences can be shortened in this way. In addition, it is likewise possible to lift the bridge laying device together with the bridge down from the vehicle once more. In this case, too, a two-part loading process is not required.

It is also advantageous for the bridge laying device, and in particular the main part of the bridge laying device, to be capable of being picked up by the load transport vehicle by means of a lifting device and of being secured in place on the load transport vehicle. The use of a lifting device fitted as standard on a load transport vehicle enables the bridge laying device to be picked up in a simple manner from the load transport vehicle. In addition, the bridge laying device can be secured in place on the load transport vehicle, thereby preventing it from slipping off or from being displaced from the vehicle, for example, during a driving motion.

It is particularly preferable for the bridge to be capable of being laid by means of the bridge laying device once it has been picked up and secured in place. As a result, it is not necessary to unload the bridge laying device from the vehicle first, before then laying the bridge. Instead, the bridge can also be laid directly from the vehicle. The vehicle can simply be driven up to the obstacle, and the bridge can be laid over the obstacle. It is also conceivable, however, for the bridge to be capable of being laid by means of the bridge laying device when it has not been picked up.

A preferred embodiment further proposes that the laying arm and the carrier arm carry the in particular single-piece bridge in the transport position, whereby the bridge can be fixed by means of the carrier arm. Because of their position at the front and at the rear on the main part or on opposing sides of the main part, the laying arm and the carrier arm are able to pick up the bridge at two points that are comparatively distant from one another, resulting in secure positioning of the bridge. The bridge can be fixed by means of the carrier arm, wherein for this purpose fixing devices such as bolts or the like can be provided on the carrier arm. These can then be released for laying the bridge.

In a method of the kind mentioned by way of introduction, the object is accomplished by the displacement of an extending device for moving the laying arm from a transport position into an extended placing position. In this case, too, the advantages already described in conjunction with the bridge laying device and the bridge laying system can occur alone or in combination.

BRIEF DESCRIPTION OF THE DRAWINGS

Further details and advantages of the invention are explained in more detail below on the basis of the illustrative embodiments represented in the drawings, in which.

DETAILED DESCRIPTION

Figure 1:
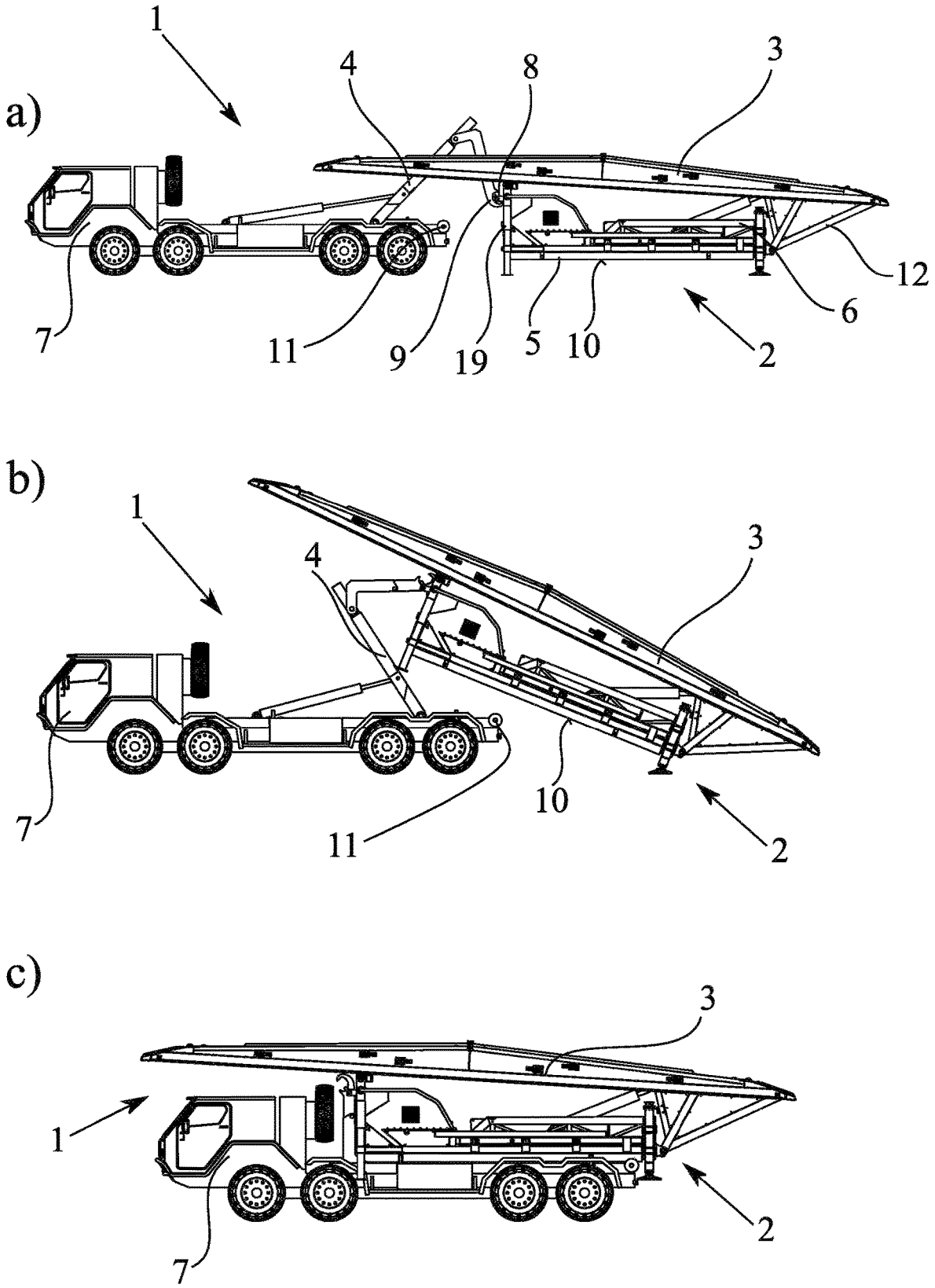
FIG. 1 depicts in a lateral view various positions of the loading or unloading process of an inventive bridge laying device with a load transport vehicle.

Depicted in FIG. 1 is a bridge laying system 1 with a load transport vehicle 7 and a bridge laying device 2 with the bridge 3 picked up. Suchlike bridge laying systems 1 are used in particular in the military sector, in order to be able to bridge obstacles 21 temporarily by means of a transportable bridge 3. This is necessary in particular if, for example, ditches or the like are present, which must be bridged in order to permit passage. In this case, the load transport vehicle 7 can be driven up to the obstacle 21, the bridge 3 can be laid there temporarily, and the bridge 3 can subsequently be picked up once more.

As can be appreciated, the load transport vehicle 7 is a readily available standard truck, for example a hook lift truck, which can be used for the transport of the bridge laying device 2. A suchlike vehicle 7 can have a lifting device 4 in the manner of a hook arm with a hook 9, for example. In addition to bridge laying devices 2, transport containers such as ISO containers or tank containers, for example, can also be transported with these vehicles 7. It is not necessary in this respect to provide a special bridge laying vehicle, for example in the form of a battle tank. The vehicle 7 possesses a load area, on which corresponding modules can be accommodated.

A bridge laying device 2, which is described here in more detail, can be picked up from the vehicle 7 by means of the lifting device 4 for the transport of a bridge 3 and can then be transported to the installation site. The bridge 3 can then be laid there with the help of the bridge laying device 2. The bridge 3 can be picked up once more and transported away after it has been used. The procedure for loading an inventive bridge laying device 2 on a vehicle 7 is represented by way of example in FIGS. 1*a* to 1*c* and will be explained in more detail on the basis of this representation.

The particular advantage of the inventive bridge laying system 1 is that the use of a single-piece bridge 3 permits higher loads to be carried by this bridge than is the case, for example, with connected two-piece bridges. For example, tanks or the like are therefore also able to travel over the bridge 3. The bridge 3 to be laid is already configured to be ready for use in the transport position, so that it is no longer necessary to assemble the bridge 3 ahead of the laying process, to unfold it or to install roadway elements or the like. Weak points, which prevent use with heavy vehicles, can be reduced in this way. In particular, the bridge 3 is a rigid bridge 3 and is not, for example, a foldable or collapsible bridge.

In FIG. 1*a* the bridge laying device 2 is still in an unloaded state on a normal supporting surface. In order to load the bridge laying device 2, the lifting device 4 arranged on the load transport vehicle 7 can engage in attachment means 8 arranged on the bridge laying device 2. The attachment means 8 can be configured for this purpose, for example as an engagement device roughly in the manner of an eye. As further depicted in FIG. 1*a*, the attachment means 8 are situated in an elevated position, in particular on a carrier arm 19, so that picking up of the bridge laying device 2 can be simplified.

As further depicted in FIG. 1*b*, the bridge laying device 2 can then be raised with the help of the lifting device 4 and drawn onto the load area of the load transport vehicle 7. A sliding surface 10 can be provided for this purpose on the underside of the bridge laying device 2 and, in particular, on the main part 5, which can come into engagement, for example, with rollers 11 arranged on the transport vehicle 7. The most frictionless possible picking up of the bridge laying device 2 can take place in this way. In addition, roller elements that are not represented in more detail here can also be provided in the region of the sliding surface 10, which further simplify the picking up.

The representation in FIG. 1*c* finally depicts the load transport vehicle 7 with the bridge laying device 2 after having been picked up. The bridge laying device 2 can be secured in place on the vehicle 7 in this position. Movements of the bridge laying device 2 can be prevented in this way, for example as the vehicle 7 is being driven. The vehicle 7 can then drive to the installation site in this position, and the bridge 3 can be laid in situ. The vehicle 7 represented in FIG. 1*c* is in its transport position, in which the in particular single-piece bridge 3 has been picked up onto the bridge laying device 2 and can thus be transported to an installation site. The bridge 3 can already be laid in this state by means of the bridge laying device 2 that has been picked up and secured in place.

The bridge laying device 2 in this case, as depicted by the representations in FIG. 1, is capable of being loaded together with the bridge 3. There is accordingly no requirement initially to pick up the bridge laying device 2 with the help of the lifting device 4 of the vehicle 7 in a first step and then to pick up the bridge 3 in a subsequent step. Instead, picking up of the bridge 3 and the bridge laying device 2 can take place in a single step, whereby the operating sequences can be simplified and the loading times can be shortened.

Now that the loading of the bridge laying device 2 onto a vehicle 7 has been examined above, details of the bridge laying device 2 itself will now be examined in more detail below on the basis of the representation in FIG. 2.

The bridge laying device 2 is on the whole of modular configuration. The bridge laying device 2 on the one hand has a main part 5, which is capable of being arranged on the load transport vehicle 7. On the other hand, an extending device 6 is arranged on the main part 5, with which a laying arm 12 for setting down and picking up a single-piece bridge 3 can be moved from a transport position into an extended placing position.

The extending device 6 in this case is capable of displacement, in particular in the horizontal direction in relation to the main part 5. In this way, the extending device 6 can be extended in the laying direction V of the bridge 3, in order, by so doing, to change the bridge laying device 2 in terms of its length. Larger distances behind the vehicle 7 can also be bridged in this way. The stability when laying the bridge 3 can be increased in addition by lengthening the bridge laying device 2. The extending device 6 can be moved in any desired manner in the process. The expressions moving or extension are also commonly referred to as pivoting outwards or pushing outwards in this context. Represented in FIG. 2 is a mechanism, in which the extending device 6 is pushed out in the laying direction V, for example via rail elements.

The laying arm 12 for laying the bridge 3 is arranged on the extending device 6 in the inventive bridge laying device 2 and is thus capable of movement together with the extending device 6. The laying arm 12 in this case is arranged in particular on the front end of the extending device 6 in the laying direction V. The movements of the extending device 6, in particular its extension in the horizontal direction, and of the laying arm 12, in particular its pivoting, can take place independently of one another. In particular, the movements of the extending device 6 and of the laying arm 12 can be disconnected from one another. The extending device 6 and/or the laying arm 12 can accordingly be actuated selectively. In this context, however, there is nothing to prevent both of the actuation processes from taking place at the same time. The laying arm 12 is of an overall triangular form and is supported with respect to the extending device 6 at a pivot point SP about a pivot axis S with a pivoting motion. The upper part of the laying arm 12 is constituted by an upper carrier 12.1, which extends in the transport position substantially horizontally to the extending device 6. A drive element 14 and roller guides 15 are arranged on the upper carrier 12.1 of the laying arm 12. These can be used in particular for laying and/or picking up the bridge 3. Provided underneath the carrier 12.1 are further carriers, which constitute a type of supporting structure 12.2 for the upper carrier 12.1 and converge on one another in the direction of the pivot axis S. The pivot axis S and thus the bearing point of the laying arm 2 is arranged in the region of the lower corner of the triangle, resulting in a comparatively low-level arrangement of the pivot axis S.

Figure 2:
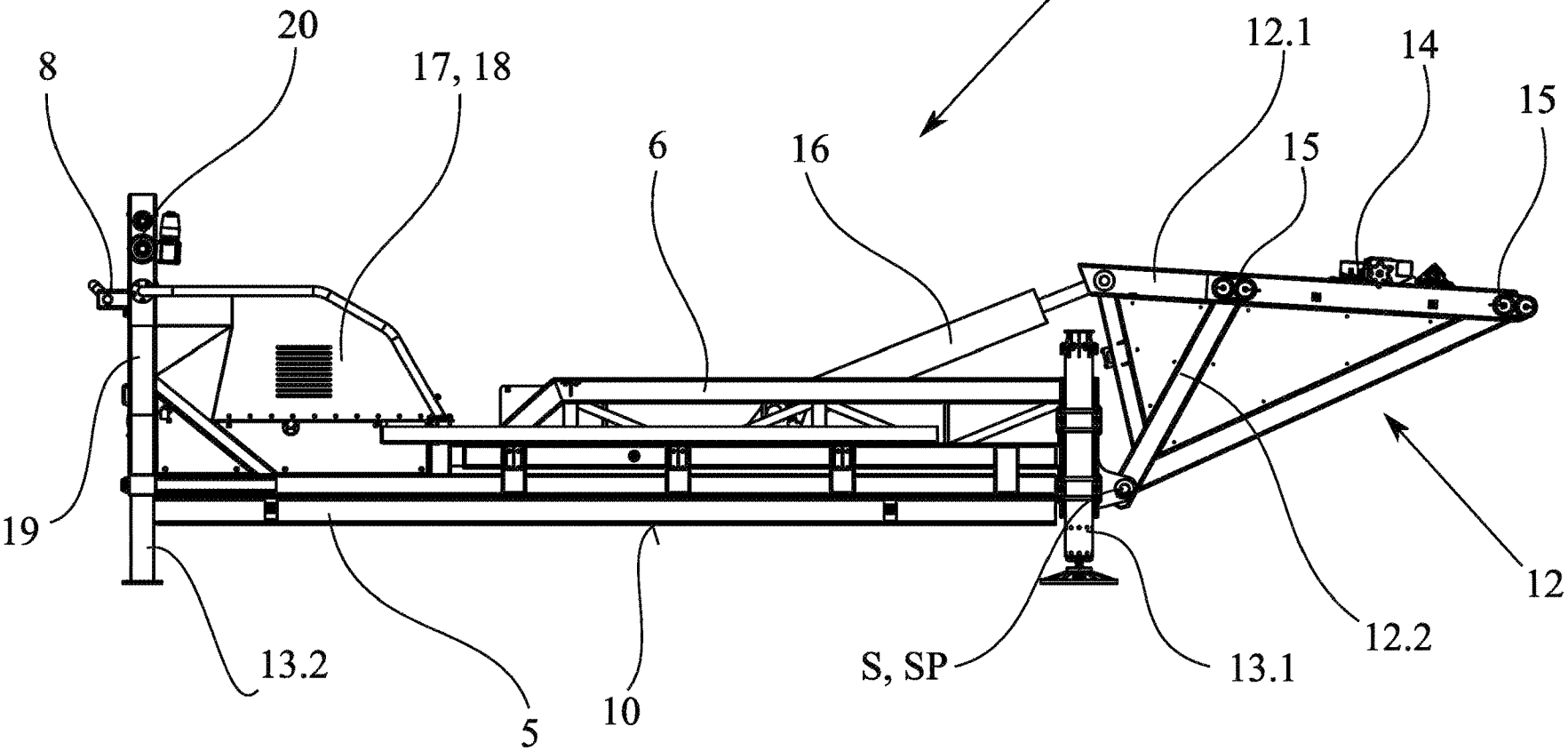
FIG. 2 depicts a schematic representation of an inventive bridge laying device without the bridge being picked up.

As can be further appreciated from FIG. 2, the laying arm 12 is pivotable via a laying drive 16 arranged on the extending device 6, in particular via a length-adjustable hydraulic cylinder. The laying drive 16 in this case is arranged on the corner of the triangle facing towards the vehicle 7. The laying drive 16 in this case, in particular in the transport position, engages on an elevated point of the laying arm 12 in relation to the pivot axis S. The laying drive 16 is a hydraulic cylinder, which on the one hand is connected to the laying arm 12 with a pivoting motion and on the other hand is connected to the bridge laying device 2 with a pivoting motion via a mounting point arranged on the extending device 6. The front end of the triangle in this case constitutes the free end of the laying arm 12, which can be pivoted downwards or upwards by actuation of the length-adjustable laying drive 16 when laying and/or picking up the bridge 3, so that picking up and setting down of the bridge 3 is possible. In the represented transport position, the laying drive 16 is approximately in alignment with the carrier 12.1 of the laying arm 12 for picking up the bridge 3. Upon actuation of the laying drive 16, this pivots about the mounting point above the contour of the extending device 6.

In addition to the laying drive 16, other drives for individual devices of the bridge laying device 2 be provided. For example, an extension drive 17 for moving the extending device 6 can be arranged on the main part 5. In addition, a control device 18, which can serve for the control of the laying arm 12 and/or the extending device 6, can be arranged on the main part 5. Both the extension drive 17 and the control device 18 can be arranged in a housing, which, as represented in FIG. 2, is arranged on the end of the main part 5 of the bridge laying device 2 opposite the laying arm 12. The laying drive 16 and/or the extension drive 17 and/or the control device 18 can be supplied with energy in this case via an autonomous energy source, not described in detail here, or also via an electrical interface arranged on the main part 5. The energy source can be configured for this purpose, for example as a battery or the like, and can supply the individual units 16, 17, 18 with power. As an alternative or in addition, the individual drives 16, 17 or the control device 18 can be supplied with energy via an electrical interface, for example by means of a cable. A bridge laying device 2, which acts completely independently of the vehicle 7 and is capable of laying a bridge 3, is made available in this way. It is thus not necessary to have recourse, for example, to control components or the like of the vehicle 7.

The length of the main part and the length of the bridge 3 in this case are substantially in a ratio of 1:5, preferably in a ratio of 1:3 and most preferably in a ratio of 1:2. The bridge 3 can have a length in the region of 10 m to 20 m, preferably in the region of 12 m to 17 m, although preferably substantially of 14 m. The main part 5 can have a length in the region of 2.5 m to 13 m, preferably in the region of 5 m to 10 m, although preferably substantially of 7 m.

The bridge laying device 2 can be used in different positions. On the one hand, the use of the bridge laying device 2 without a vehicle 7 and the use of a bridge laying device 2 from a vehicle 7 is possible as a result. In the former case, the bridge laying device 2 can be set down on the supporting surface, and the bridge 3 can be laid from there. In the second case, the bridge laying device 2 remains on the vehicle 7 and lays the bridge 3 from there.

In order to facilitate setting down of the bridge laying device 2 on the supporting surface, and in order to increase the stability of the vehicle 7 with the bridge laying device 2 loaded thereon, the bridge laying device 2 has at least four support devices 13, via which the bridge laying device 2 is able to support itself in relation to the supporting surface. In particular, two of the support devices 13.2 can be arranged on the main part 5, and two support devices 13.1 can be arranged on the extending device 6. The support devices 13.1, which are arranged on the extending device 6, are of vertically adjustable configuration, unlike the support devices 13.2 of the main part 5. The stability of the vehicle 7 in a laying process, in which the bridge laying device 2 is arranged on the vehicle 7 and is secured in place there, can be increased in this way. In this case, the extending device 6 can be moved in the laying direction V and is then able to support itself via the support devices 13.1 in relation to the supporting surface. What is more, the support point of the support devices 13.1 can be displaced as required by the extension of the extending device 6. In the case in which the bridge laying device 2 is standing autonomously on the supporting surface, the support devices 13.1 are in a retracted position, wherein the length of the vertically adjustable support devices 13.1 corresponds to the length of the support devices 13.2.

A further element, which is arranged on the bridge laying device 2, is the carrier arm 19. This is arranged on the front end of the main part 5, wherein the engagement device 8 in particular can also be arranged on an elevated position of the carrier arm 19. The carrier arm 19 can be configured in particular to carry the bridge 3 in the transport position together with the laying arm 12 and to fix the bridge 3 on the bridge laying device 2. Fixing devices 20 can also be provided for this purpose, for example cylinders or bolts, which can be retracted and extended as required. Fixing of the bridge 3 in the transport position is possible in this way. In the placing position, the fixing device 20 can be released and the bridge 3 can be laid.

Figure 3:
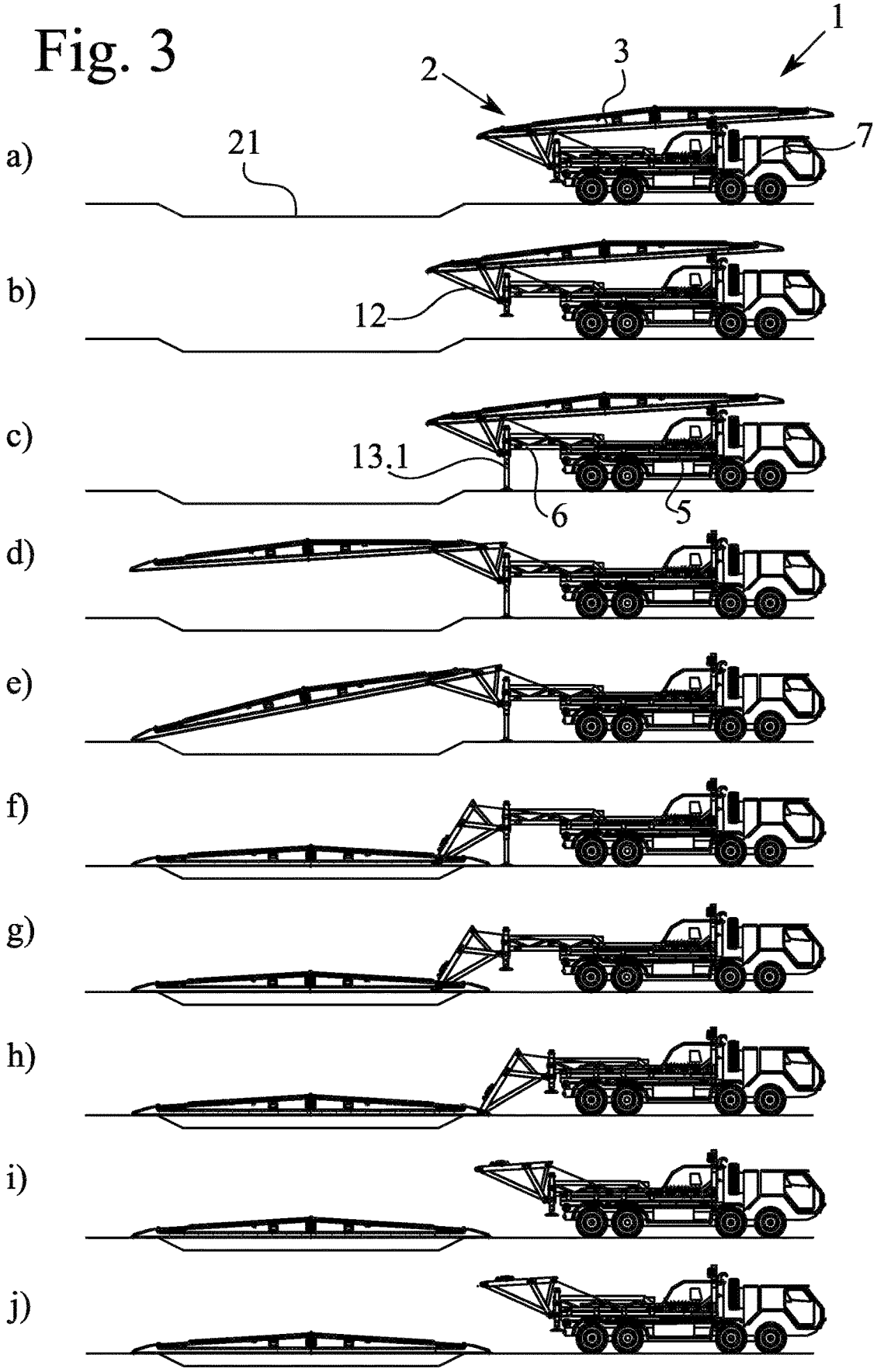
FIG. 3 depicts various positions of the bridge laying device for the illustration of a laying process.

The process sequence of a laying procedure of a bridge, in particular a single-piece bridge 3 with an inventive bridge laying device 2, is now represented in FIG. 3. As can be appreciated, the bridge laying device 2 is present on a load area of the load transport vehicle 7, wherein the bridge 3 is secured in place on the bridge laying device 2 between the laying arm 12 and the carrier arm 19. The vehicle 7 in this position is able to travel backwards in the direction of the obstacle 21, in order to bring the bridge laying device 2 into a position in which the bridge 3 can be laid. A suchlike representation is depicted in FIG. 3*a*.

In conjunction herewith, the extending device 6 can then be displaced in relation to the main part 5, in particular in the laying direction V, in order to bridge the distance between the vehicle 7 and the obstacle 21 in this way and, in addition, to increase the stability. In order to support the extending device 6, the support devices 13.1 can then be extended in a subsequent step, so that they come into contact with the supporting surface. The extending device 6 and, in particular, also the laying arm 12 can thus be supported additionally in relation to the supporting surface. Once the bridge 3 has been brought into the position represented in FIG. 3*c*, the bridge 3 can be brought into the position marked in FIG. 3*d*, driven via the drive element 14 of the laying arm 12. The bridge 3 is then set down by actuation of the laying drive 16 in the manner depicted in FIGS. 3*e* to 3*h*. The laying arm 12 can then be brought back into its original position, in which the upper carrier 12.1 is oriented substantially horizontally to the extending device 6. The same procedure can then be repeated in the reverse sequence in order to pick up the bridge 3.

In particular, a single-piece bridge 3 can be transported in a simple manner with any load transport vehicle 7 and can be laid at an installation site with the help of the bridge laying device 2 described above and with the help of the associated bridge laying system 1. There is thus no requirement to provide a special bridge laying vehicle. Larger distances, in particular between the vehicle 7 and an obstacle 21, can also be bridged by the extending device 6, while at the same time maintaining stability during the laying process.

REFERENCE DESIGNATIONS

1 bridge laying system
2 bridge laying device
3 bridge
4 lifting device
5 main part
6 extending device
7 load transport vehicle
8 attachment means
9 hook
10 sliding surface
11 rollers
12 laying arm
12.1 upper carrier
12.2 supporting structure
13 support devices
13.1 height-adjustable support devices
13.2 rigid support devices
14 drive element
15 roller guides
16 laying drive
17 extension drive
18 control device
19 carrier arm
20 fixing device
21 obstacle
V the laying direction
S pivot axis
SP pivot point

The invention claimed is:

1. A bridge laying device for laying a bridge, the bridge laying device having a main part (5) for arranging on a load transport vehicle (7), and a laying arm (12) that sets down the bridge (3), the bridge laying device comprising:

an extending device (6) that moves the laying arm (12) from a transport position into an extended placing position;

a laying drive (16) arranged on the extending device (6), the laying drive including a length-adjustable hydraulic cylinder attached to and extending between the extending device and the laying arm;

an extension drive (17) arranged on the main part that moves the extending device relative to the load transport vehicle;

a control device (18) arranged on the main part (5) that controls the laying arm (12) and/or the extending device (6), wherein the length-adjustable hydraulic cylinder pivots the laying arm (12);

a plurality of support devices (13) that support the main part (5) and the extending device (6) in relation to a supporting surface, the plurality of support devices supporting the main part and the extending device on the supporting surface independently of the load transport vehicle, wherein at least two of the support devices (13.2) are arranged on the main part (5) and at least two of the support devices (13.1) are arranged on the extending device (6); and wherein one or more of the laying drive (16), the extension drive (17), and the control device (18) receive energy from an autonomous energy source and/or by an electrical interface arranged on the main part (5).

2. The bridge laying device as claimed in claim 1, wherein the extending device (6) is arranged on the main part (5) and is capable of displacement in the horizontal direction relative to the main part (5).

3. The bridge laying device as claimed in claim 1, wherein the laying arm (12) is arranged on the extending device (6) and is movable together with the extending device (6).

4. The bridge laying device as claimed in claim 1, wherein the laying device is connected to the main part at a pivot axis, and the laying drive (16) in the transport position is connected to an elevated point of the laying arm (12) relative the pivot axis (S).

5. The bridge laying device as claimed in claim 1, wherein the extension drive (17) for moving the extending device (6) is arranged on the main part (5).

6. The bridge laying device as claimed in claim 1, further comprising means for attachment (8) provided on the main part (5) that attach the main part (5) to a load transport vehicle (7), the means for attachment including an engagement device for receiving a hook (9) arranged on the load transport vehicle (7).

7. The bridge laying device as claimed in claim 1, further comprising a carrier arm (19) for carrying and retaining the bridge (3) in the transport position.

8. A bridge laying system, the system comprising a hook lift load transport vehicle (7) and the bridge laying device (2) as claimed in claim 1 that is arranged on the hook lift load transport vehicle (7), the bridge laying device for laying a single-piece bridge with a main part (5) and a laying arm (12) for setting down the single-piece bridge (3).

9. The bridge laying system as claimed in claim 8, wherein the bridge laying device (2) is capable of being loaded together with the bridge (3) on the hook lift load transport vehicle.

10. The bridge laying system as claimed in claim 8, wherein the hook lift load transport vehicle includes a lifting device, and the main part (5) of the bridge laying device (2) is capable of being picked up by the lifting device (4) of the hook lift load transport vehicle (7) and the bridge laying device is capable of being secured in place on the hook lift load transport vehicle (7).

11. The bridge laying system as claimed in claim 8, wherein the bridge (3) is capable of being laid by means of the bridge laying device (2) that has been picked up and secured in place.

12. A method for laying a bridge with a bridge laying device (2), the bridge laying device having a main part (5) arranged on a load transport vehicle (7), and a laying arm (12) that sets down the bridge (3) on a supporting surface, the method comprising:

moving an extending device (6) to move the laying arm (12) from a transport position into an extended placing position;

controlling the laying arm (12) and/or the extending device (6) with a control device (18) arranged on the main part (5) to pivot the laying arm (12) by a length-adjustable hydraulic cylinder of a laying drive (16) arranged on the extending device (6);

supplying one or more of the laying drive (16), an extension drive (17), and the control device (18) with energy from an autonomous energy source and/or from an electrical interface arranged on the main part (5); and supporting the main part and the extending device (6) with support devices (13) relative to the supporting surface independently of the load transport vehicle, the support devices including at least two of the support devices (13.2) arranged on the main part (5) and at least two of the support devices (13.1) are arranged on the extending device (6).

13. The method of claim 12, further comprising displacing the extending device relative to the main part to bridge a distance between the vehicle and an obstacle to be covered by the bridge; and driving a drive element of the laying arm to bring the bridge into a desired position.

14. The method of claim 13, further comprising pivoting the laying arm upwardly to the transport position by the extending device.

* * * * *